US006146722A

United States Patent [19]

Slawin

[11] Patent Number: 6,146,722

[45] Date of Patent: Nov. 14, 2000

[54] FIGURE OF AN ANIMATED CREATURE FOR RETAINING AND DISPLAYING A PICTURE

[76] Inventor: Thryn Slawin, 9210 S. Trumbull Ave., Evergreen Park, Ill. 60805

[21] Appl. No.: 09/178,046

[22] Filed: Oct. 23, 1998

[51] Int. Cl.[7] ..... A47G 1/12; A47G 35/00

[52] U.S. Cl. ..... 428/13; 428/14; 428/542.2; 446/321; 446/337; 446/372; 40/791

[58] Field of Search ..... 428/13, 14, 542.2; 446/321, 372, 337; 40/791, 798

[56] References Cited

U.S. PATENT DOCUMENTS 5,842,900 12/1998 Hodge ..... 446/73

*Primary Examiner*—Deborah Jones
*Assistant Examiner*—Abraham Bahta
*Attorney, Agent, or Firm*—Michael R. McKenna

[57] ABSTRACT

A figure of an animated creature for retaining and visually displaying a picture. The figure has a body with a front side upon which means for retaining and visually displaying the picture are disposed. The means for retaining and visually displaying has a transparent outer cover for displaying the picture.

29 Claims, 3 Drawing Sheets

FIGURE OF AN ANIMATED CREATURE FOR RETAINING AND DISPLAYING A PICTURE

BACKGROUND OF THE INVENTION

This invention relates to a figure of an animated creature for retaining and visually displaying a picture comprising a body of the figure with a front side and means for retaining and visually displaying the picture disposed on the front side of the body of the figure. As is well known and understood, young children like figures of animated creatures, particularly stuffed animals. There are different types of stuffed animals but they are essentially limited to functioning as objects and not as a picture displaying device. A figure of an animated figure can include a stuffed animal such as a kitten or a pony, giraffe as represented in the drawing, or a teddy bear, frog, lion or any other animated creature.

The figure of the present invention encourages bonding between a child and an animal figure since it may retain and display a picture of the child, the parents, a sibling or some other subject matter which is familiar to the child. This combination of a figure and picture holding device provides an easily identifiable and familiar possession for even a young child.

It is an object of the present invention to provide a figure of an animated creature which can visually display pictures or the like. It is yet another object of the invention to provide a figure of an animated creature that has a general appearance of a stuffed animal.

In accordance with the illustrative embodiments demonstrating features and advantages of the present invention, there is provided a figure of an animated creature that can removably retain a picture or the like and visually display same. Accordingly, the present invention must provide a figure and a means for retaining and visually displaying a picture.

Still other advantages will be apparent from the disclosure that follows.

SUMMARY OF THE INVENTION

The invention relates to a figure of an animated creature for retaining and visually displaying a picture. It comprises a body of the figure having a front side and a back side, and extremities including arms, legs, and a head, and means for retaining and visually displaying the picture disposed on the front side of the body of the figure.

The present invention discloses that the means for retaining and visually displaying the picture has a outer cover with a forward face and a rearward face, and a bottom edge, a top edge, and spaced upstanding side edges connecting the respective ends of the top edge to the bottom edge. The outer cover may be made of a transparent material and may be contoured to the front side of the body upon which it is disposed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
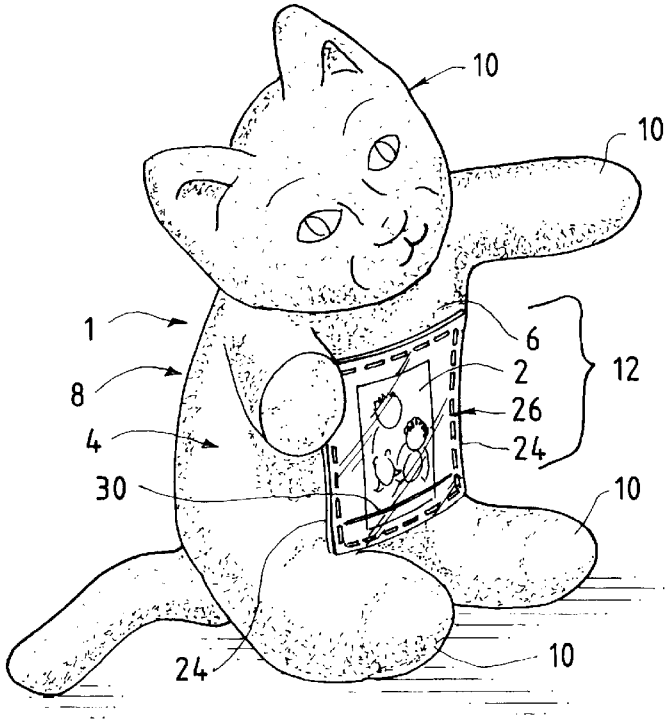
FIG. 1 is a perspective view of a preferred embodiment of the present invention of a figure of an animated creature for retaining and visually displaying a picture (the picture itself, which is interchangeable, is not part of the invention)

The preferred embodiments depicted in the drawing include a FIG. 1 of an animated creature for retaining and visually displaying a picture 2 or the like.

Without departing from the generality of the invention disclosed herein, the means for retaining and visually displaying 12 the picture 2 may have a outer cover 14 and a back wall 32 with the picture disposed therebetween.

The discussion that follows, without limiting the scope of the invention, will refer to the invention as depicted in the drawing, showing the FIG. 1 of an animated creature for retaining and visually displaying a picture in a variety of preferred embodiments. It comprises a body 4 of the figure with a front side 6 and a back side 8, and extremities 10 including arms, legs, and a head, and means for retaining and visually displaying 12 the picture 2 disposed on the front side 6 of the body 4 of the figure.

The present invention discloses that the means for retaining and visually displaying the picture has a outer cover 14 with forward face 16 and a rearward face 18, and a bottom edge 20, a top edge 22, and spaced upstanding side edges 24 connecting the respective ends of the top edge 22 to the bottom edge 20. The outer cover 14 comprises a section 44 made of a transparent material and may be contoured to the front side 6 of the body 4 upon which it is disposed.

A sheet 46 and the front cover 14 are respectively attached to the body 4 of the figure in such a way as to cause a squeezing pressure therebetween. In this way, the picture 2 may be squeezably maintained between the front cover 14 and the sheet 46.

Figure 11:
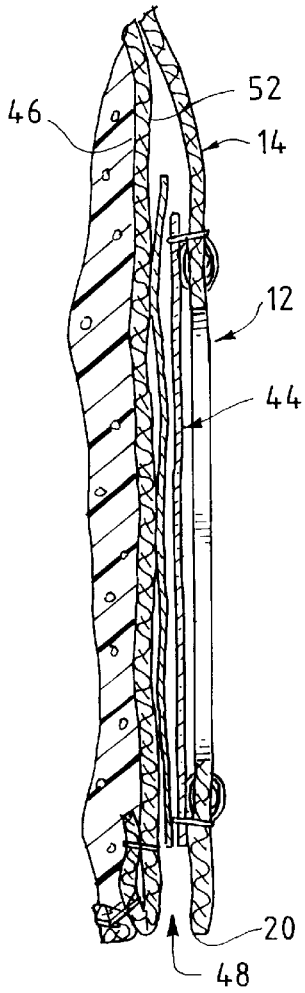
FIG. 11 is the side elevation view taken along line 11—11 of FIG. 10 showing a picture disposed between the sheet attached to the front side of the body of the figure and the outer cover.

In the preferred embodiment shown in FIG. 11, the means for retaining and visually displaying 12 further comprises an opening 48, in which the picture 2 may be inserted between the outer cover 14 and the front side 6, partially bounded by the bottom edge 20 of the front cover 14.

Figure 10:
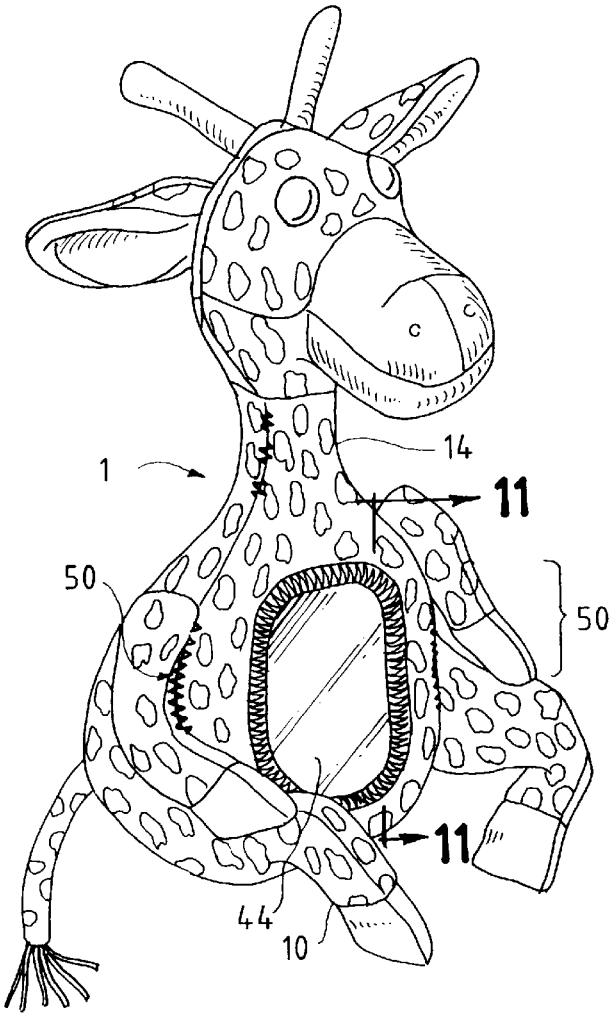
FIG. 10 is a perspective view of another preferred embodiment of the present invention of a figure of an animated creature for retaining and visually displaying a picture with a transparent window disposed adjacent to an aperture in the front cover and an opening for picture insertion disposed adjacent to bottom edge of the outer cover.
Figure 12:
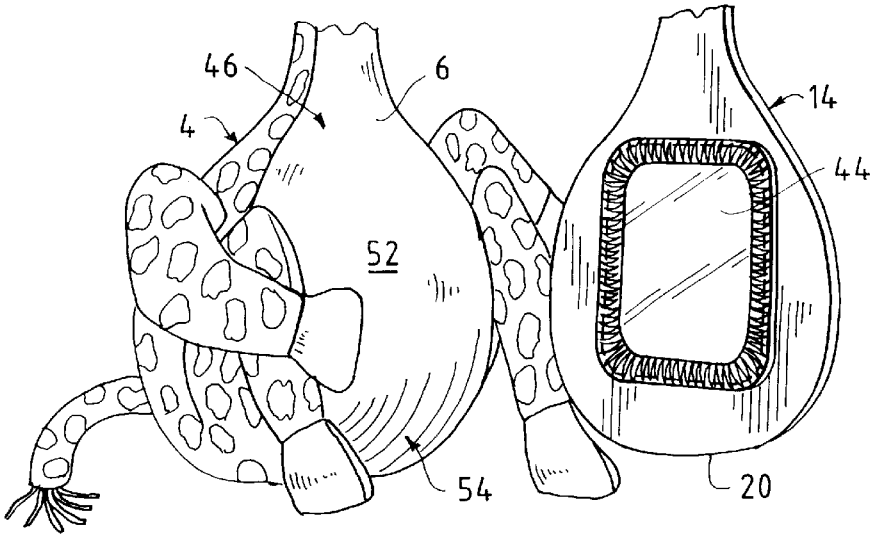
FIG. 12 is an exploded fragmentary perspective view of the sheet attached to the front side of the body of the figure and the front cover with a transparent section.

The sheet 46 of the front side 6 and the outer cover 14 may be respectively attached to the body 4 of the figure in such a way as to cause a squeezing pressure therebetween. The picture 2 in such case will be squeezably maintained between the outer cover 14 and the sheet 46. As best shown in FIGS. 10, 11 and 12 the outer cover 14 may be attached to the front side 6 of the body 4 along at least three peripheral edges. In the embodiment shown in the drawing the bottom edge 20 of the outer cover is not attached.

Figure 2:
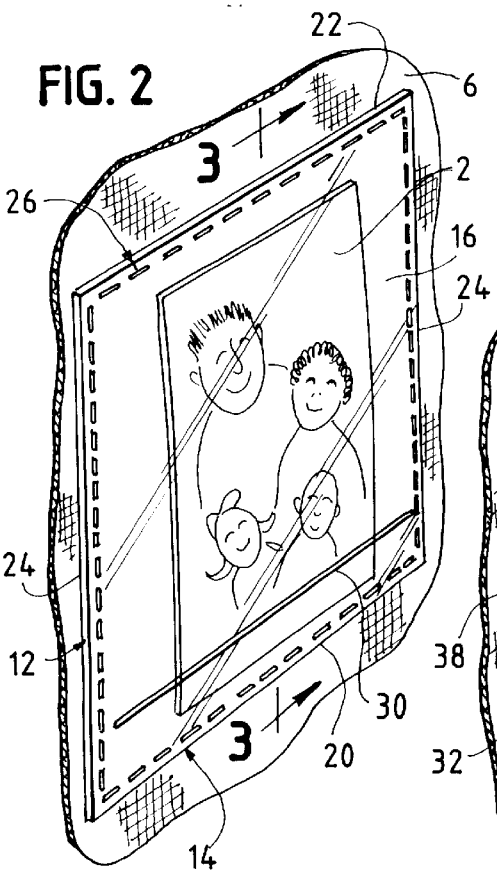
FIG. 2 is a cut away perspective view showing details of the means for holding of the present invention.

Referring to FIGS. 1 and 2, the front cover 14 is shown made of a transparent material and in FIG. 1, the outer cover 14 is contoured to the front side 6 of the body 4, whereas, in FIG. 2 the outer cover 14 is generally flat.

Figure 3:
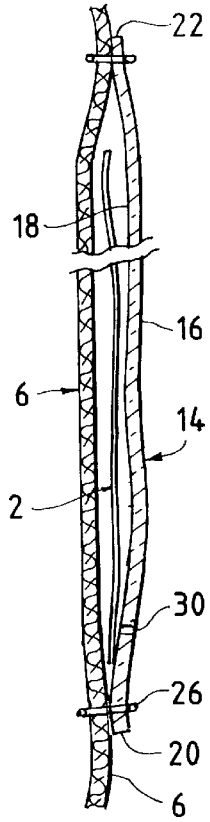
FIG. 3 is the side elevation view taken along line 3—3 of FIG. 2 showing a picture disposed between the body of the figure and the front cover.
Figure 4:
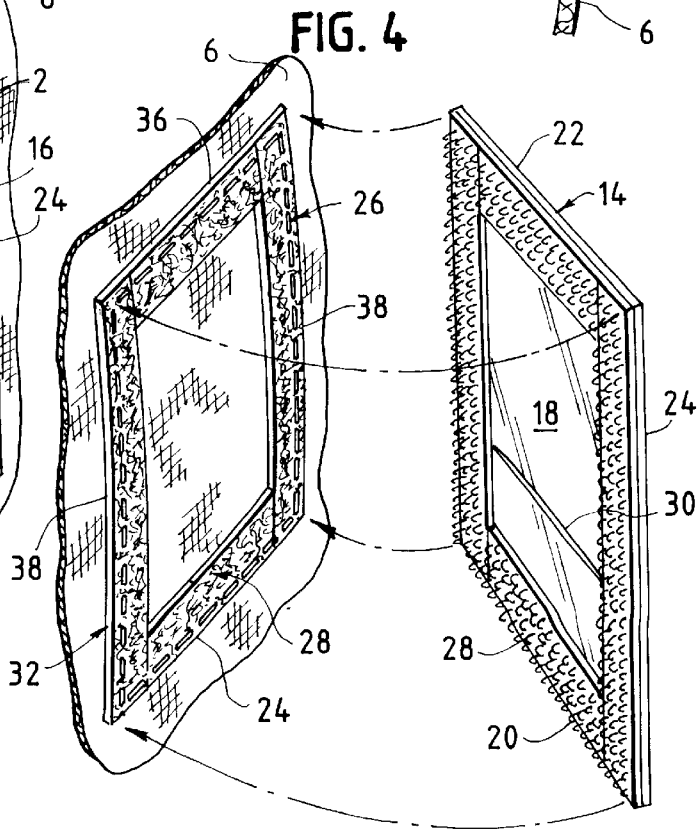
FIG. 4 is a cut away perspective view of the means for retaining and visually displaying showing a back wall stitched to the figure and a outer cover reversibly detached from the back wall.
Figure 5:
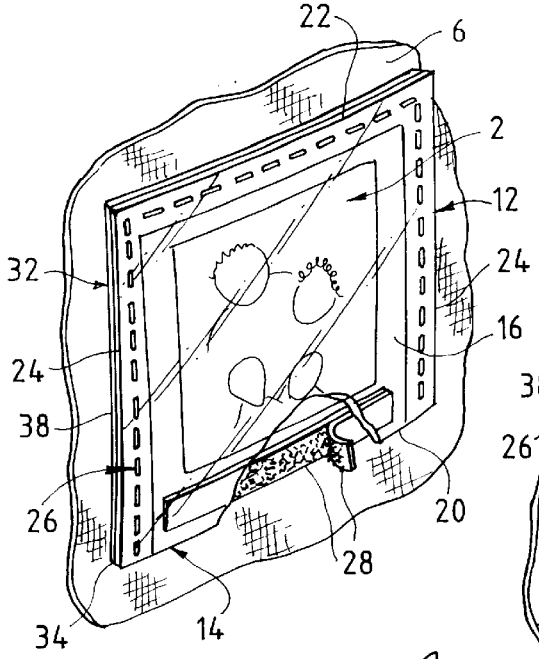
FIG. 5 is a cut away perspective view of a preferred embodiment of the present invention showing a Velcro®-like hook and loop material disposed along the bottom edge of the means for retaining and visually displaying which secures an opening into which a picture may be inserted.
Figure 6:
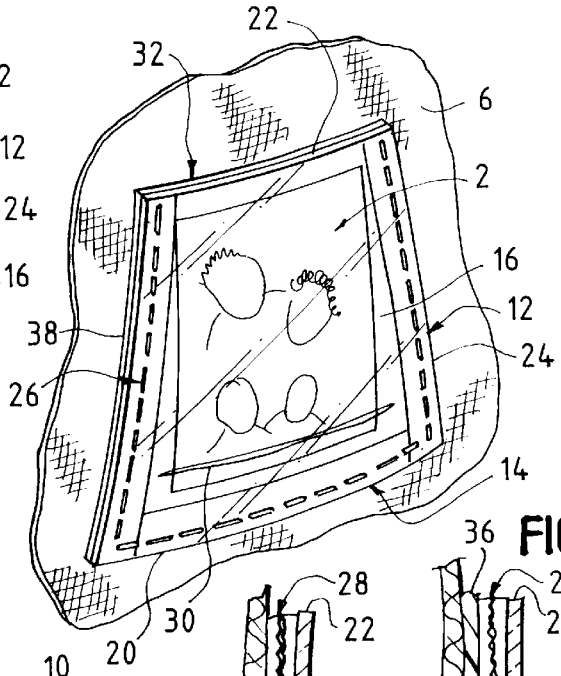
FIG. 6 is a perspective view showing a trapezoidal means for retaining and visually displaying with an elongated slit disposed on the outer cover into which a picture may be inserted.
Figure 8:
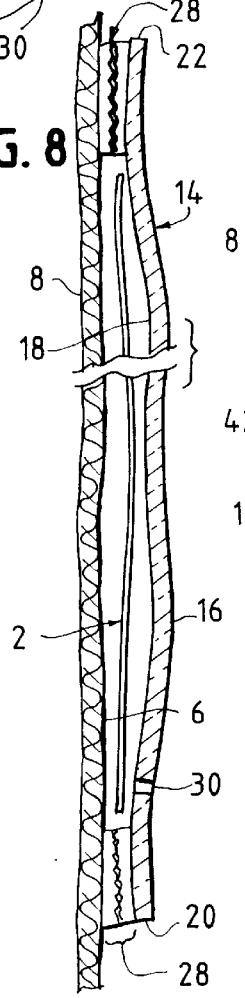
FIG. 8 is a side elevation view of a preferred embodiment of the figure of the present invention taken along line 8—8 of FIG. 7 showing a picture disposed between the body of the figure and a outer cover reversibly attached to the body by hook and loop material.

Referring to FIGS. 5 and 6, there is shown another preferred embodiment of the FIG. 1 in which the outer cover 14 is attached to the front side 6 of the body 4 along at least three peripheral edges. The outer cover 14 is attached to the front side 6 of the body 4 along the top edge 22 and the upstanding side edges 24. The outer cover 14 may be attached by stitching 26 to the front side 6 of the body 4, as shown in FIGS. 1 and 3. Additionally, the outer cover 14 may be reversibly attached to the front side 6 of the body 4 with hook and loop material 28, as best seen in FIG. 8. Furthermore, the outer cover may be attached to the front side of the body along each of the peripheral edges (20, 22, and 24, respectively), as shown in FIGS. 1, 2, and 4–6. The outer cover 14 is attached by stitching 26 to the front side 6 of the body 4, as shown in these figures of the drawing.

In another preferred embodiment of the figure of the current invention, the outer cover 14 has at least one elongated opening 30 in which the picture 2 may be inserted therein. See FIGS. 1–4 and 6–9. Furthermore, the at least one elongated opening 30 may be disposed proximate to the bottom edge 20 of the outer cover 14. Additionally, the outer cover 14 may be made of a transparent material.

In another preferred embodiment of the figure of the current invention shown in FIG. 6, the length of the bottom edge 20 of the outer cover 14 is larger than the length of the top edge 22 thereof.

Figure 7:
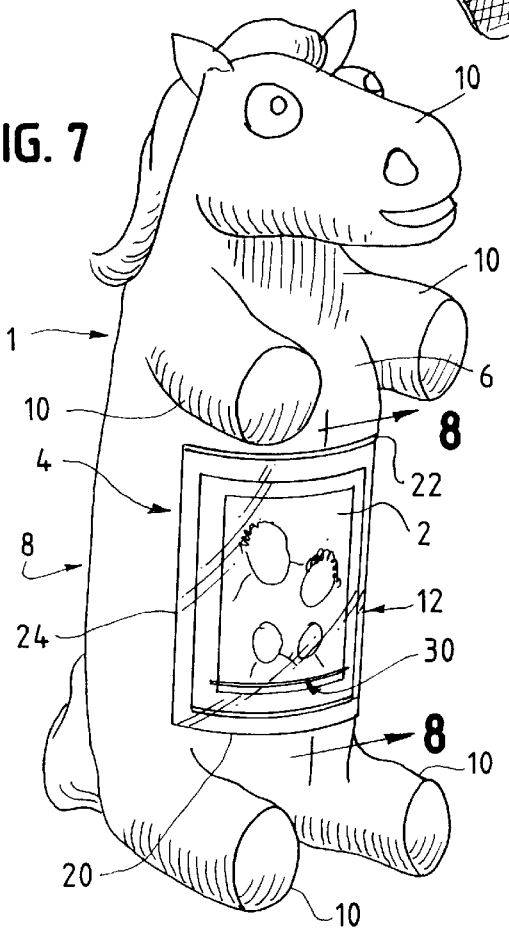
FIG. 7 is a perspective view of a preferred embodiment of the figure of the present invention showing means for retaining and visually displaying contoured to the front side of the body of the figure.

As best shown in FIG. 7, the outer cover 14 may be contoured to the front side 6 of the body 4 upon which it is disposed. The outer cover 14 may be made of a semi-rigid material to prevent the picture 2 from becoming distorted or otherwise damaged. The outer cover 14 may be comprised of plexiglass or the like.

In one preferred embodiment of the FIG. 1 of the current invention, the means for retaining and visually displaying 12 may further comprise a back wall 32 having a bottom edge 34, a top edge 36, and spaced upstanding side edges 38 connecting the respective ends of the top edge 36 to the bottom edge 34, the back wall 32 being disposed between the front side 6 of the body 4 and the outer cover 14. Moreover, the outer cover 14 may have transverse dimensions in all directions that are at least as great as the back wall 32. The back wall 32 could be made to have transverse dimensions in all directions larger that the outer cover 14. This would allow illustrations and the like to be accommodated.

The FIG. 1 of the present invention comprises a back wall 32 which has an exposed surface 40 and a contact surface 42 with the contact surface being attached to the front side 6 of the body 4.

Referring to FIG. 4, another preferred embodiment of the figure of the current invention is shown in which the back wall 32 has a hook and loop material 28 disposed adjacent the peripheral edge of its exposed surface 40 and the outer cover 14 has a complementary hook and loop material disposed adjacent the peripheral edge of its rearward face 18 for mating engagement with the hook and loop material 28 of the back wall 32. Additionally, the back wall 32 may be contoured to the front side 6 of the body 4 upon which it is disposed.

While stitching 26 is shown in the drawing, hook and loop mating material 28, or an equivalent, could have been employed so that the means for retaining and visually displaying 12 could be removably attached to the FIG. 1. Moreover, a back wall 32 having the contours of the front side 6 of the body 4 upon which it is disposed can be permanently attached to the FIG. 1, and hook and loop material 28 can be used to removably attach a transparent front cover 14 thereon with the picture 2 disposed between the back wall 32 and the front cover 14, as shown in FIG. 4.

Figure 9:
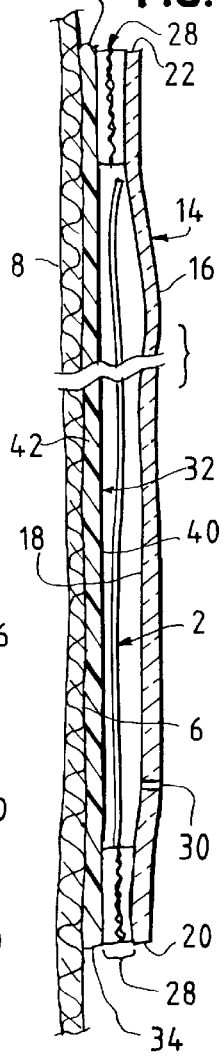
FIG. 9 is a side elevation view of a preferred embodiment of the figure of the present invention showing a picture disposed between a back wall which is attached to the body of the figure and a outer cover reversibly attached to the back wall by hook and loop material.

Alternatively, the means for retaining and visually displaying 12 can be permanently attached with a elongated opening 30 provided in the outer cover 14 for the insertion of a picture 2 or the like. Furthermore, the elongated opening 30 may be employed with a outer cover 14 that is reversibly attached giving the user the option of inserting the picture 2 through the opening 30 or of detaching the outer cover 14 for installing the picture 2 in the means for retaining and visually displaying 12, as shown in FIGS. 4, 8, and 9.

As best shown in FIG. 6, a preferred embodiment of the instant invention provides for a trapezoidal shape which will allow irregularly shaped pictures having an expanded base to be conveniently retained and displayed in the figure of the current invention.

Moreover, by employing VELCRO®-like hook and loop mating material 28 to some of the interface connections between the outer cover 14 and the remaining portions of the FIG. 1 (in FIG. 5, the bottom edge 20 of the outer cover 14 and the bottom edge 34 of the back wall 32). The outer cover 14 can be reversibly rolled, as shown in FIG. 5, to a position in which a picture 2 may be inserted for display behind the front cover 14.

In another preferred embodiment of the figure of the current invention, the back wall 32 may comprise a semi-rigid material to prevent the picture 2 from becoming crimped or otherwise damaged.

In another preferred embodiment, as best shown in FIGS. 7, 11 and 12, the FIG. 1 of an animated creature for retaining and visually displaying a picture 2 comprises a body 4 of the figure with a front side 6 and a back side 8, and extremities 10 including arms, legs, and a head; the front side comprises a sheet 46 having a predetermined size and shape with a peripheral edge; and means for retaining and visually displaying 12 the picture disposed on the front side of the body of the figure. The means for retaining and visually displaying the picture has a outer cover 14 with forward face 16 and a rearward face 18, and a bottom edge, a top edge, and spaced upstanding side edges connecting the respective ends of the top edge to the bottom edge. The outer cover 14 further has a size and shape corresponding to the predetermined size and shape of the sheet 46.

One of the embodiment of the invention provides that the sheet and outer cover are respectively attached to the body of the figure in such a way as to cause a squeezing pressure therebetween. This causes the picture to be squeezably maintained between the front cover and the sheet. This may be accomplished by providing that at least one transverse dimension of the front cover measured in one of a plurality of first directions between the closest points of attachment does not substantially exceed a corresponding transverse dimension between the closest points of attachment of the sheet.

Referring to FIGS. 10 and 12, the sheet 46 is overlaid with the outer cover 14 so that the arrangement of the peripheral edges of the sheet correspond with the like-shaped peripheral edges of the outer cover. Also shown is the outer cover attached to the front side of the body along the top edge and the upstanding side edges, and an opening 48, in which the picture may be inserted between the outer cover and the front side, partially bounded by the bottom edge 20 of the front cover 14.

At least one transverse dimension of the outer cover measured in one of a plurality of first directions does not substantially exceed a corresponding transverse dimension of the sheet, and in which the sheet and the outer cover are both attached to the body along at least one set of opposing portions 50 of their respective peripheral edges, shown best in FIG. 10. The at least one set of opposing portions passing through one of the plurality of first directions. This configuration of attachment of the sheet and outer cover to the body of the figure causes a squeezing pressure between the sheet 46 and the outer cover 14 sufficient to maintain the picture 2 between said outer cover and said sheet.

Additionally, the sheet 14 may comprise an outward surface 52 (or the exposed surface 40 of the back wall 32, where employed) with a rough texture 54 providing friction between the outward surface and the picture disposed adjacent thereto.

Referring to FIGS. 10–12, another preferred embodiment of the FIG. 1 of an animated creature for retaining and visually displaying a picture comprises a body 4 of the figure with a front side 6 and a back side 8, and extremities 10 including arms, legs, and a head, and means for retaining and visually displaying 12 the picture disposed on the front side of the body of the figure.

The front side 6 comprises a sheet 46 having a predetermined size and shape with a peripheral edge. Moreover, the means for retaining and visually displaying 12 the picture has a outer cover 14 with forward face 16 and a rearward face 18, and a bottom edge 20, a top edge 22, and spaced upstanding side edges 24 connecting the respective ends of the top edge to the bottom edge. The outer cover 14 also has a size and shape corresponding to the predetermined size and shape of the sheet 46.

Furthermore, the sheet 46 and outer cover 14 may be respectively attached to the body 4 of the figure in such a way as to cause a squeezing pressure therebetween, whereby, the picture 2 may be squeezably maintained between the outer cover 14 and the sheet 46.

In one embodiment of the figure of this important invention, the sheet 46 may be overlaid with a outer cover 14 of similar size so that the arrangement of the peripheral edges of the sheet correspond with the like-shaped peripheral edges of the outer cover. Stitched together and attached to the body of the figure will causes a squeezing pressure between the sheet and the outer cover sufficient to maintain the picture between said outer cover and said sheet.

Additionally, the outer cover 14 may be attached to the front side 6 of the body 4 along the top edge 22 and the upstanding side edges 24, and further comprise an opening 48, in which the picture may be inserted between the outer cover and the front side 6, partially bounded by the bottom edge 20 of the front cover 14.

Functionally, at least one transverse dimension of the outer cover measured in one of a plurality of first directions does not substantially exceed a corresponding transverse dimension of the sheet, and in which the sheet and the outer cover are both attached to the body along at least one set of opposing portions 50 of their respective peripheral edges. The at least one set of opposing portions 50 pass through one of the plurality of first directions. Attachment of the sheet and outer cover to the body of the figure will cause a squeezing pressure between the sheet and the outer cover sufficient to maintain the picture between said outer cover and said sheet.

In a preferred embodiment of the invention shown in FIG. 12, the sheet 46 comprises an outward surface 52 with a rough texture 54 providing friction between said outward surface and the picture 2 disposed adjacent thereto.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

The invention resides not in any one of these features per se, but rather in the particular combination of all of them herein disclosed and claimed and it is distinguished from the prior art in this particular combination of all of its structures for the function specified.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A figure of an animated creature for retaining and visually displaying a picture comprising:

a. a body of the figure with an outer side and a back side, and extremities; and b. means for retaining and visually displaying the picture independent of the orientation of the figure disposed on the front side of the body of the figure, said means for retaining and visually displaying the picture having an outer cover through which the picture is displayed and means for receiving the picture free of displacing the outer cover, said outer cover comprising at least a section made of a transparent material.

2. The figure of claim 1, in which the outer cover is attached to the body of the figure in such a way as to cause a squeezing pressure therebetween, whereby, the picture is squeezably maintained between the outer cover and the body.

3. The figure of claim 1, wherein the outer cover is attached to the front side of the body along at least three peripheral edges.

4. The figure of claim 3, wherein the outer cover is attached to the front side of the body along the top edge and the upstanding side edges.

5. The figure of claim 4, further comprising an opening, in which the picture is inserted between the outer cover and the front side, that is partially bounded by a bottom edge of the outer cover.

6. The figure of claim 1, wherein the outer cover is attached by stitching to the front side of the body.

7. The figure of claim 1, wherein the outer cover is reversibly attached to the front side of the body with hook and loop material.

8. The figure of claim 1, wherein the outer cover is attached to the front side of the body along a peripheral edge.

9. The figure of claim 8, wherein the outer cover is attached by stitching to the front side of the body.

10. The figure of claim 8, wherein the outer cover has at least one elongated opening through which the picture is inserted therein.

11. The figure of claim 10, wherein the at least one elongated opening is disposed proximate to a bottom edge of the outer cover.

12. The figure of claim 1, wherein the length of a bottom edge of the outer cover is larger than the length of a top edge thereof.

13. The figure of claim 1, wherein the outer cover is semi-rigid to prevent the picture from becoming distorted or otherwise damaged.

14. The figure of claim 13, wherein the at least a section of the outer cover made of a transparent material comprises plexiglass.

15. The figure of claim 1, wherein the means for retaining and visually displaying further comprises a back wall having a peripheral edge, said back wall being disposed between the front side of the body and the outer cover.

16. The figure of claim 15, wherein the outer cover has transverse dimensions in all directions that are at least as great as the back wall.

17. The figure of claim 15, wherein the back wall has an exposed surface and a contact surface with the contact surface being attached to the front side of the body.

18. The figure of claim 17, wherein the exposed surface of the back wall has a hook and loop material disposed adjacent the peripheral edge, and wherein the outer cover has a complementary hook and loop material disposed adjacent a peripheral edge of its rearward face for mating engagement with the hook and loop material of the back wall.

19. The figure of claim 15, wherein the back wall is contoured to the front side of the body upon which it is disposed.

20. The figure of claim 19, wherein the back wall comprises a semi-rigid material to prevent the picture from becoming crimped or otherwise damaged.

21. A figure of an animated creature for retaining and visually displaying a picture comprising:

a. a body of the figure with a front side and a back side, and extremities; and b. means for retaining and visually displaying the picture independent of the orientation of the figure disposed on the front side of the body of the figure, said means for retaining and visually displaying the picture having an outer cover, said outer cover being contoured to the front side of the body upon which it is disposed.

22. A figure of an animated creature for retaining and visually displaying a picture comprising:

a. a body of the figure with a front side and a back side, and extremities, said front side comprising a sheet having a predetermined size and shape with a peripheral edge; and b. means for retaining and visually displaying the picture independent of the orientation of the figure disposed on the front side of the body of the figure, said means for retaining and visually displaying the picture having an outer cover through which the picture is displayed and means for receiving the picture free of displacing the outer cover, with forward face and a rearward face, and a bottom edge, a top edge, and spaced upstanding side edges connecting the respective ends of the top edge to the bottom edge, said outer cover having a size and shape corresponding to the predetermined size and shape of the sheet.

23. The figure of claim 22, in which the sheet and outer cover are respectively attached to the body of the figure in such a way as to cause a squeezing pressure therebetween, whereby, the picture is squeezably maintained between the outer cover and the sheet.

24. The figure of claim 22, wherein the sheet is overlaid with the outer cover so that the arrangement of the peripheral edges of the sheet correspond with like-shaped peripheral edges of the outer cover.

25. The figure of claim 24, in which attachment of the sheet and outer cover to the body of the figure causes a squeezing pressure between the sheet and the outer cover sufficient to maintain the picture between said outer cover and said sheet.

26. The figure of claim 25, in which the outer cover is attached to the front side of the body along the top edge and the upstanding side edges, and further comprising an opening, in which the picture is inserted between the outer cover and the front side, partially bounded by the bottom edge of the outer cover.

27. The figure of claim 24, in which at least one transverse dimension of the outer cover measured in one of a plurality of first directions does not substantially exceed a corresponding transverse dimension of the sheet, and in which the sheet and the outer cover are both attached to the body along at least one set of opposing portions of their respective peripheral edges, said at least one set of opposing portions passing through one of the plurality of first directions.

28. The figure of claim 25, in which the attachment of the sheet and the outer cover to the body of the figure causes a squeezing pressure between the sheet and the outer cover sufficient to maintain the picture between said outer cover and said sheet.

29. The figure of claim 22, in which the sheet comprises an outward surface with a rough texture providing friction between said outward surface and the picture disposed adjacent thereto.

* * * * *